US010274278B2

(12) United States Patent
Dueck et al.

(10) Patent No.: US 10,274,278 B2
(45) Date of Patent: Apr. 30, 2019

(54) FIREARM ATTACHMENT

(71) Applicant: SureFire, LLC, Fountain Valley, CA (US)

(72) Inventors: Barry W. Dueck, Fullerton, CA (US); Michael Voigt, Corona, CA (US); Karl R. Honigmann, Anaheim Hills, CA (US)

(73) Assignee: SureFire, LLC, Fountain Valley, CA (US)

( * ) Notice: Subject to any disclaimer, the term of this patent is extended or adjusted under 35 U.S.C. 154(b) by 0 days.

(21) Appl. No.: 14/995,634

(22) Filed: Jan. 14, 2016

(65) Prior Publication Data

US 2016/0209153 A1 Jul. 21, 2016

Related U.S. Application Data

(60) Provisional application No. 62/104,326, filed on Jan. 16, 2015.

(51) Int. Cl.
*F41A 21/32* (2006.01)
*F41A 21/34* (2006.01)
*F41A 21/36* (2006.01)

(52) U.S. Cl.
CPC ..... *F41A 21/32* (2013.01); *F41A 21/34* (2013.01); *F41A 21/36* (2013.01)

(58) Field of Classification Search
CPC ..... F41A 21/34; F41A 21/36
USPC ..... 89/14.2, 14.3, 14.4
See application file for complete search history.

(56) References Cited

U.S. PATENT DOCUMENTS 1,605,393 A * 11/1926 Cutts, Jr. ..... F41A 21/36 89/14.3
2,212,685 A * 8/1940 Hughes ..... F41A 21/36 89/14.3
2,322,370 A 6/1943 Lance
2,339,777 A * 1/1944 Green ..... F41A 21/34 89/14.5
2,567,826 A 9/1951 Prache
4,545,285 A * 10/1985 McLain ..... F41A 21/36 89/14.3
4,879,942 A * 11/1989 Cave ..... F41A 21/36 89/14.3
D343,222 S * 1/1994 Morales ..... 89/14.3
5,675,107 A * 10/1997 Ledys ..... F41A 21/36 89/14.05
8,042,448 B1 10/2011 Sylvester et al.
(Continued)

*Primary Examiner* — Reginald S Tillman, Jr.
(74) *Attorney, Agent, or Firm* — Haynes and Boone, LLP

(57) ABSTRACT

Various embodiments are provided to implement an attachment for a firearm that operates as a flash hider, a muzzle brake, and/or to mount, e.g., a sound suppressor, to the firearm. In one example, a firearm attachment includes a base adapted to couple to a muzzle end of a barrel of a firearm. The firearm attachment includes a plurality of longitudinal tines that extend forward from the base. The base includes a plurality of apertures disposed rearward of the tines and that extend from a bore within the base through an outer circumfery of the firearm attachment. The apertures exhibit a first diameter at the bore and a second larger diameter at the outer circumfery. The apertures are adapted to impart thrust to the firearm attachment in response to combustion gases passed from the bore through the apertures to compensate for muzzle rise associated with the firearm.

20 Claims, 12 Drawing Sheets

(56) References Cited

U.S. PATENT DOCUMENTS

| | | | | |
|---|---|---|---|---|
| 8,418,803 | B2 * | 4/2013 | Findlay | F41A 21/30<br>181/223 |
| 9,228,789 | B1 * | 1/2016 | Oglesby | F41A 21/36 |
| 2008/0083321 | A1 * | 4/2008 | Dueck | F41A 21/36<br>89/14.3 |
| 2015/0308778 | A1 * | 10/2015 | Vossler | F41A 21/36<br>89/14.3 |

* cited by examiner

FIREARM ATTACHMENT

CROSS-REFERENCE TO RELATED APPLICATIONS

This application claims priority to and the benefit of U.S. Provisional Patent Application No. 62/104,326 filed Jan. 16, 2015 and entitled "FIREARM ATTACHMENT" which is hereby incorporated by reference in its entirety.

BACKGROUND

Field of the Invention

This disclosure relates to firearms in general, and more particularly, to attachments for firearms that can be used to prevent or suppress muzzle flash, muzzle rise, or as an attachment for mounting a firearm accessory, such as a sound suppressor or a blank firing adapter.

Related Art

Firearms, such as pistols or rifles, utilize expanding high-pressure gases generated by a burning propellant to expel a projectile from a muzzle end of a barrel of the weapon at a relatively high velocity. When the projectile, or bullet, exits the muzzle of the weapon's barrel, a bright, "muzzle flash" of light and a high-pressure pulse of combustion gases accompany it. The rapid pressurization and subsequent depressurization caused by the high-pressure pulse gives rise to a loud sound known as "muzzle blast," which, like muzzle flash, can readily indicate to a remote enemy both the location of the weapon and the direction from which it is being fired. In some situations, such as covert military operations, it is desirable to conceal such information from the enemy by suppressing the flash with a "flash hider" attachment and/or eliminating or substantially reducing the amplitude of the muzzle blast with a "sound suppressor" or "silencer."

In addition to muzzle flash and muzzle blast, the expanding high-pressure gases can also result in a phenomenon referred to as "muzzle rise" or "muzzle climb," i.e., a tendency of the muzzle of the weapon to rotate upwards relative to the horizon and sideways relative to the vertical after firing, thereby causing the weapon to miss the target aimed at and adversely affecting the accuracy of the weapon, particularly during automatic or rapid fire thereof. To prevent or reduce this undesirable effect, firearm attachments referred to as "muzzle brakes" or "recoil compensators" are often used.

Sound suppressors (also referred to as "noise suppressors" or "silencers") can be used on firearms to reduce the amplitude of their muzzle blast, and in some cases, muzzle flash. Suppressors operate to reduce muzzle blast by reducing and controlling the energy level of the propellant gases accompanying the projectile as it leaves the muzzle end of the weapon, and are typically located sufficiently forward of the muzzle end of the weapon that they can also operate effectively as a flash hider (e.g., a muzzle flash suppressor). However, for reasons of shooting accuracy, among others, suppressors typically require some mechanism for reliably mounting the suppressor to the muzzle end of the barrel of the firearm in such a way that the internal lumen of the suppressor is precisely aligned coaxially with the bore of the barrel.

Accordingly, a long-felt but as yet unsatisfied need exists in the industry for firearm attachments that can operate effectively not only to reduce or eliminate both muzzle flash and muzzle climb, i.e., as both flash hiders and muzzle brakes, but which can also be used to mount accessories, such as sound suppressors or blank firing adapters, to firearms precisely and reliably.

SUMMARY

In accordance with the present disclosure, example embodiments of novel firearm attachments are provided, together with related methods, which operate effectively to reduce or eliminate both muzzle flash and muzzle climb, and which can also be used to mount accessories, such as sound suppressors or blank firing adapters, to firearms precisely and reliably.

In one example embodiment, a firearm attachment includes a base adapted to couple to a muzzle end of a barrel of a firearm; a plurality of longitudinal tines that extend forward from the base; wherein the base includes a plurality of apertures disposed rearward of the tines and that extend from a bore within the base through an outer circumfery of the firearm attachment; wherein the apertures exhibit a first diameter at the bore and a second larger diameter at the outer circumfery; and wherein the apertures are adapted to impart thrust to the firearm attachment in response to combustion gases passed from the bore through the apertures to compensate for muzzle rise associated with the firearm.

In another example embodiment, a method includes providing a firearm attachment comprising: a base coupled to a muzzle end of a barrel of a firearm, a plurality of longitudinal tines that extend forward from the base, wherein the base includes a plurality of apertures disposed rearward of the tines and that extend from a bore within the base through an outer circumfery of the attachment, and wherein the apertures exhibit a first diameter at the bore and a second larger diameter at the outer circumfery; and passing combustion gases of the firearm from the bore through the apertures to impart thrust to the attachment to compensate for muzzle rise associated with the firearm.

The scope of the invention is defined by the claims, which are incorporated into this section by reference. A more complete understanding of the firearm attachments of the present invention will be afforded to those skilled in the art, as well as a realization of additional advantages thereof, by a consideration of the following detailed description of one or more example embodiments thereof. Reference will be made to the appended sheets of drawings, the figures of which will first be described briefly, and within which like reference numerals are used to identify like elements illustrated in one or more of the figures.

DETAILED DESCRIPTION

In accordance with the present disclosure, example embodiments of novel firearm attachments are provided, together with methods for making and using them, which can operate effectively to reduce or eliminate both muzzle flash and muzzle climb, and which can also be used to mount accessories, such as sound suppressors or blank firing adapters, to firearms in a precise and reliable manner.

Figure 1:
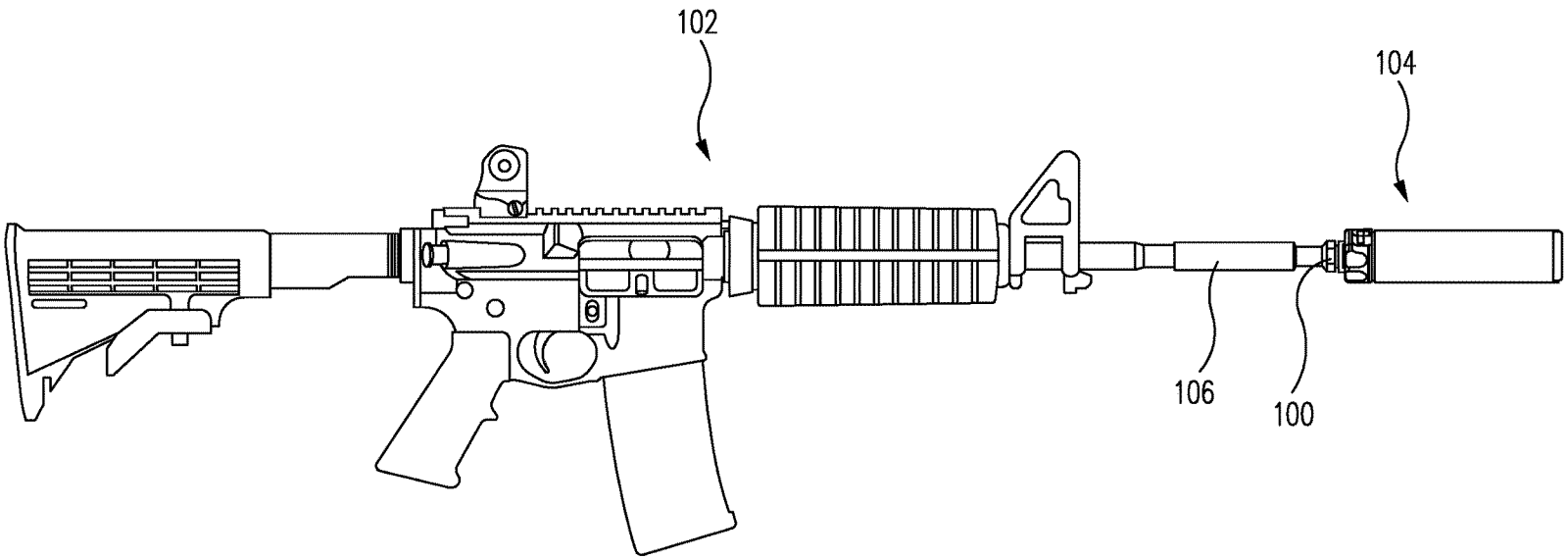
FIG. 1 is a right side elevation view of a rifle having a sound suppressor coupled to the muzzle end of a barrel of the firearm with an example embodiment of a firearm attachment in accordance with an embodiment of the present disclosure.
Figure 2:
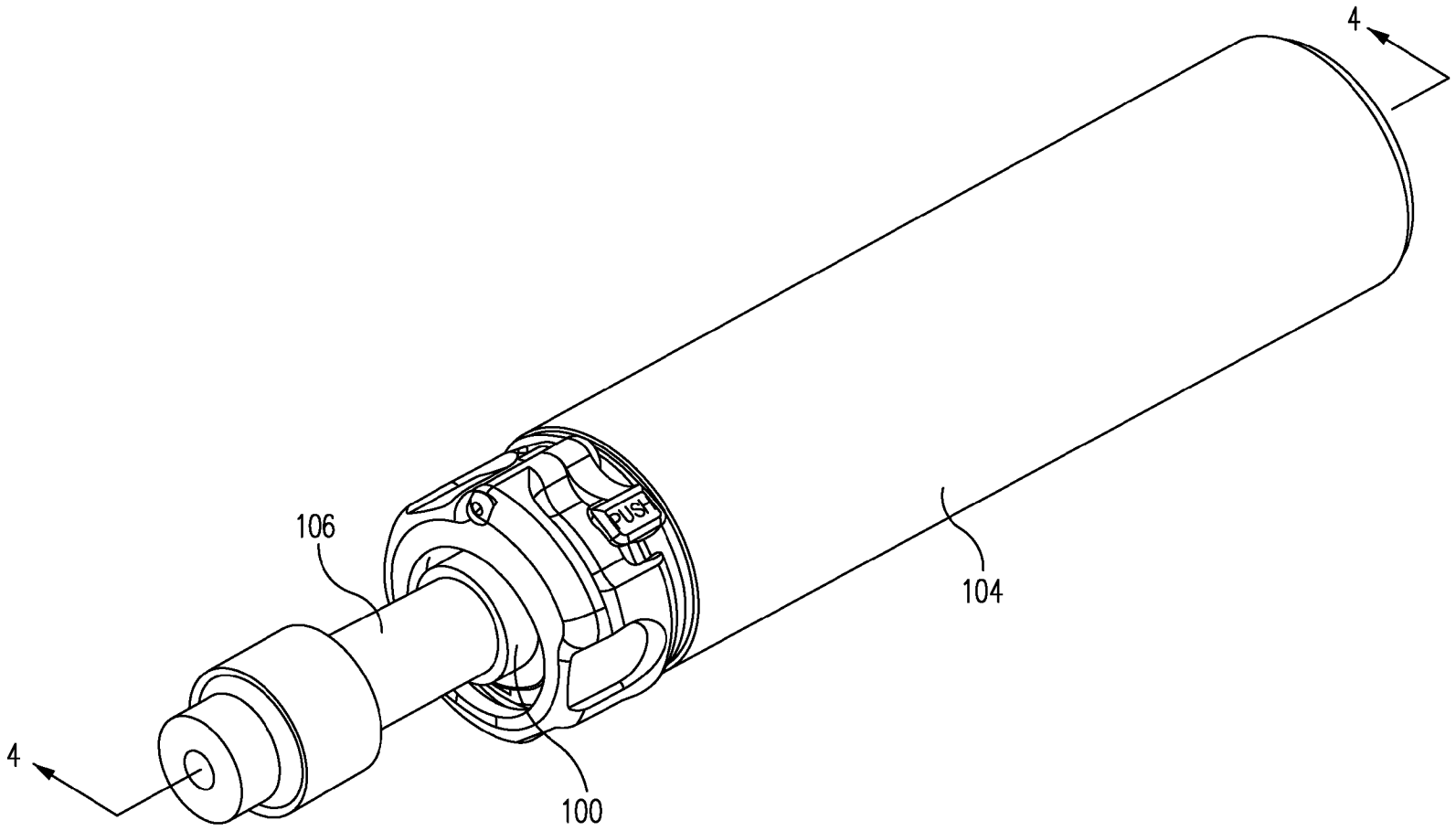
FIG. 2 is a partial rear, upper, right side perspective view of the rifle of FIG. 1, showing a muzzle end portion of the barrel of the firearm, the example firearm attachment, and the suppressor in accordance with an embodiment of the present disclosure.
Figure 3:
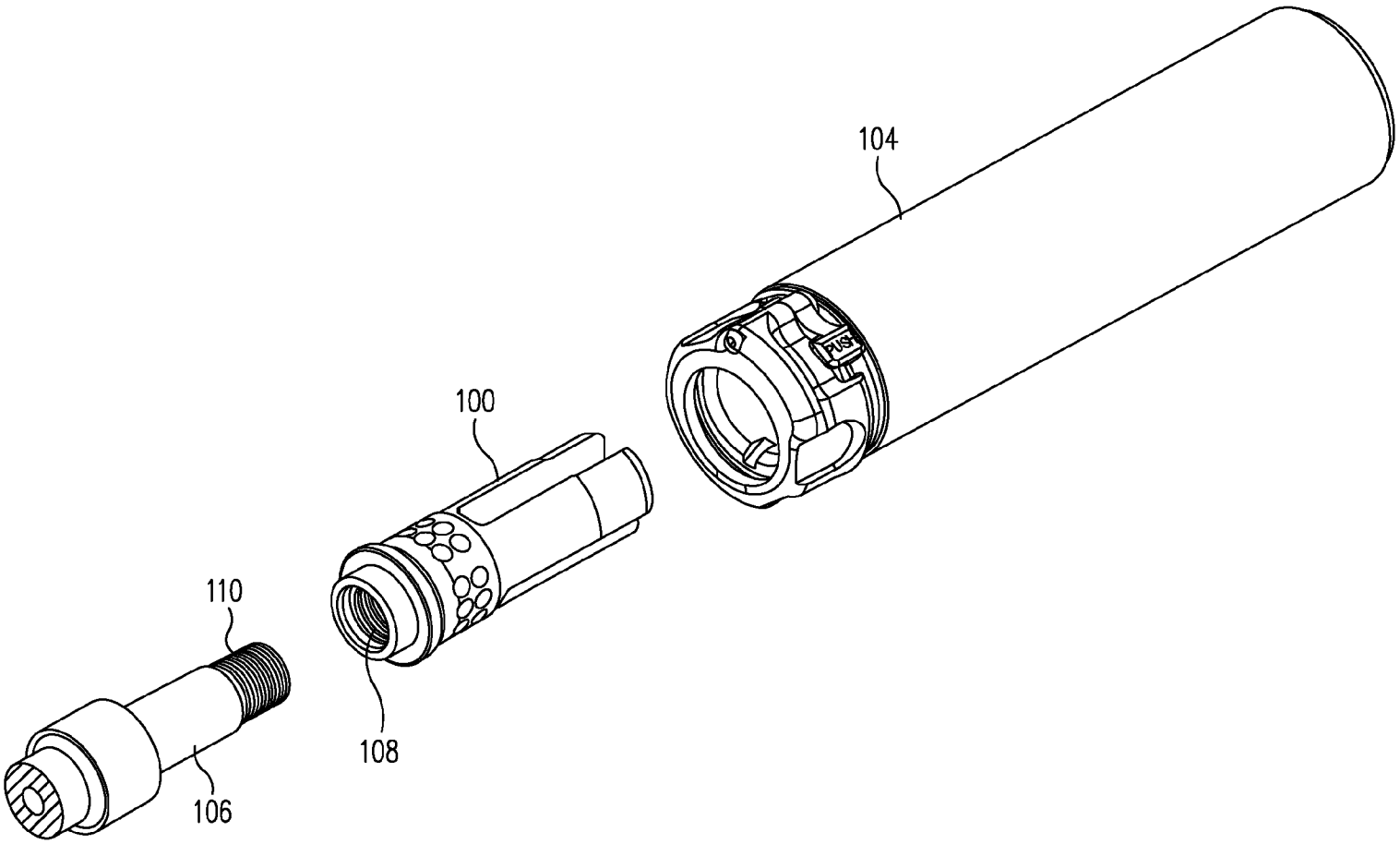
FIG. 3 is an exploded rear, upper, right side perspective view of the barrel, firearm attachment, and suppressor of FIG. 2 in accordance with an embodiment of the present disclosure.

FIG. 1 is a right side elevation view of a firearm 102, e.g., a rifle, having a sound suppressor 104 coupled to the muzzle end of a barrel 106 of the firearm 102 with an example embodiment of a firearm attachment 100 in accordance with the present disclosure. FIG. 2 is a partial rear, upper, right side perspective view of the firearm 102 of FIG. 1, showing a muzzle end portion of the barrel 106 of the firearm 102, the example firearm attachment 100, and the suppressor 104. FIG. 3 is an exploded rear, upper, right side perspective view of the barrel 106, firearm attachment 100 and suppressor 104 of FIG. 2, and FIG. 4 is a right side cross-sectional view of the barrel 106, firearm attachment 100, and suppressor 104 of FIG. 2.

Figure 4:
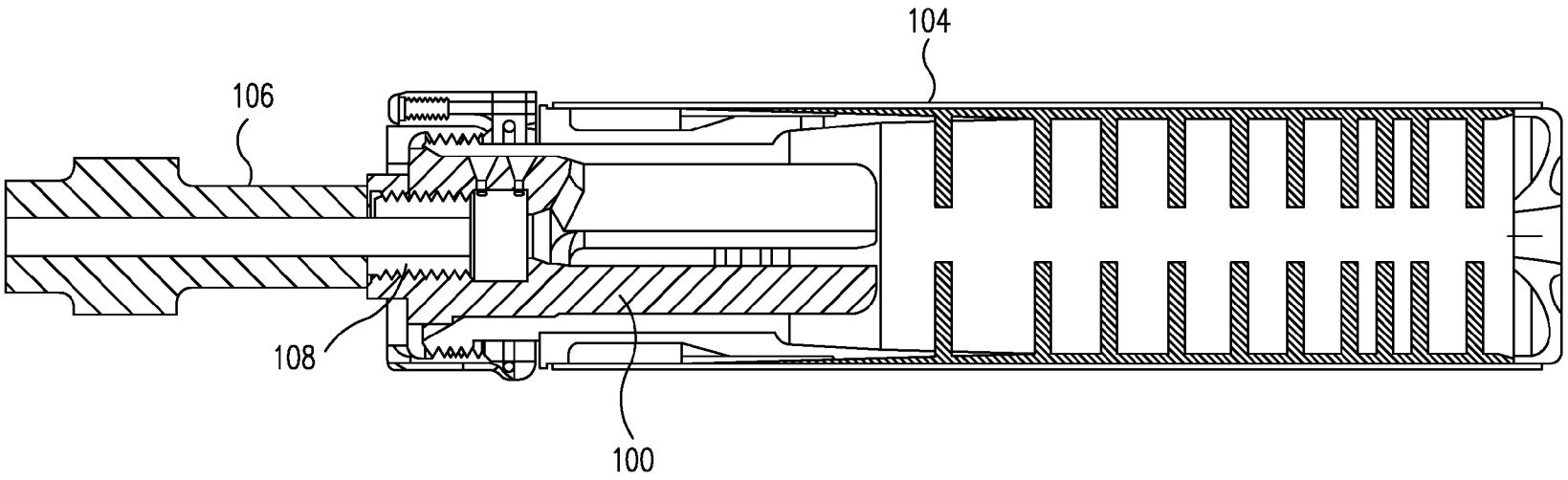
FIG. 4 is a right side cross-sectional view of the barrel, firearm attachment, and suppressor, as seen along the lines of the section 4-4 taken in FIG. 2 in accordance with an embodiment of the present disclosure.
Figure 6:
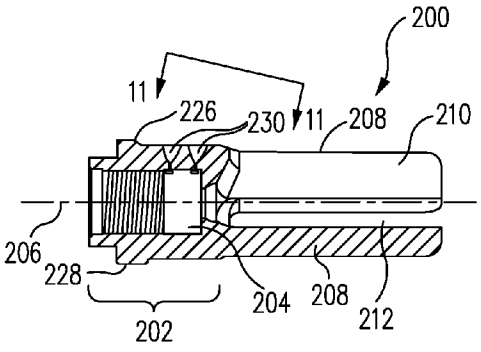
FIG. 6 is a cross-sectional view of the first example firearm attachment, as seen along the lines of the section 6-6 taken in FIG. 5 in accordance with an embodiment of the present disclosure.
Figure 8:
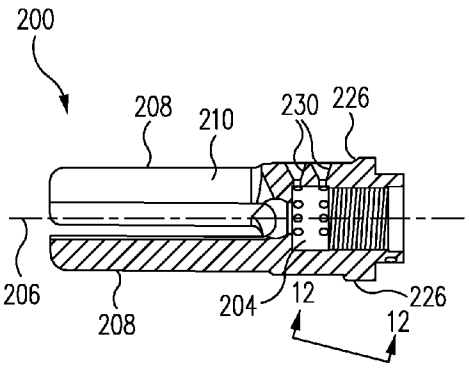
FIG. 8 is a cross-sectional view of the first example firearm attachment, as seen along the lines of the section 8-8 taken in FIG. 5 in accordance with an embodiment of the present disclosure.
Figure 5:
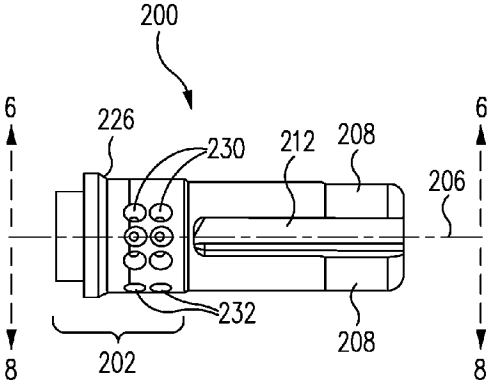
FIG. 5 is a top plan view of a first example embodiment of a firearm attachment in accordance with an embodiment of the present disclosure.
Figure 7:
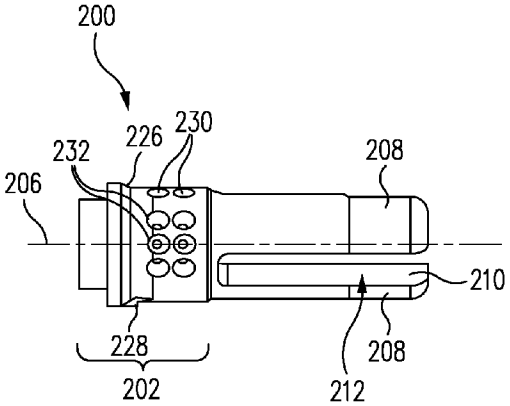
FIG. 7 is a right side elevation view of the first example firearm attachment in accordance with an embodiment of the present disclosure.
Figure 10:
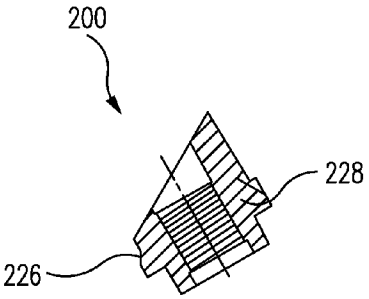
FIG. 10 is a partial cross-sectional view of the first example firearm attachment, as seen along the lines of the section 10-10 taken in FIG. 12 in accordance with an embodiment of the present disclosure.
Figure 12:
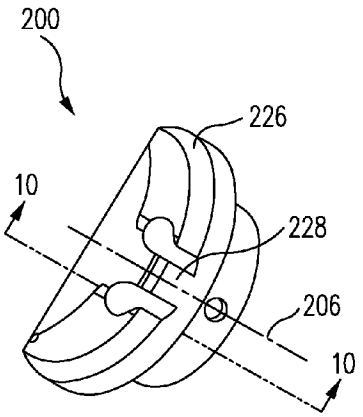
FIG. 12 is an enlarged partial detail view of the first example firearm attachment, as seen along the lines of the view 12-12 taken in FIG. 8 in accordance with an embodiment of the present disclosure.
Figure 9:
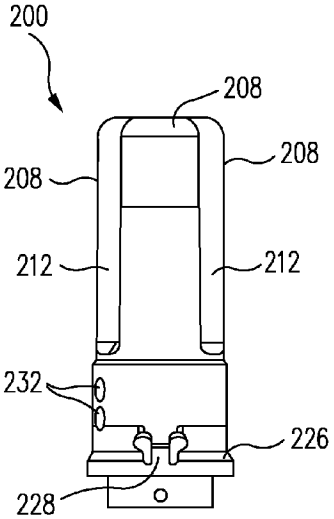
FIG. 9 is a bottom plan view of the first example firearm attachment in accordance with an embodiment of the present disclosure.
Figure 11:
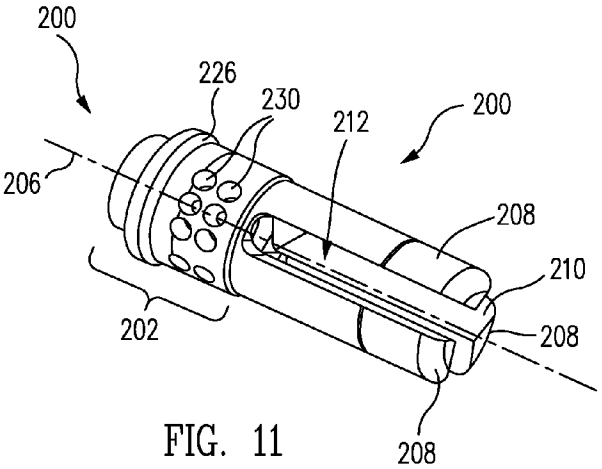
FIG. 11 is an upper, front end perspective view of the first example firearm attachment, as seen along the lines of the view 11-11 taken in FIG. 6 in accordance with an embodiment of the present disclosure.
Figure 17:
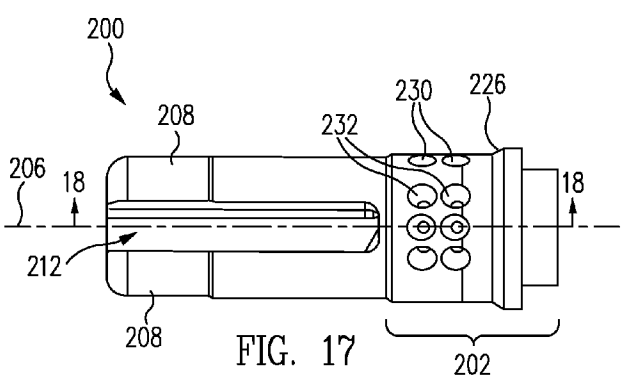
FIG. 17 is another, enlarged top plan view of the first example firearm attachment in accordance with an embodiment of the present disclosure.
Figure 18:
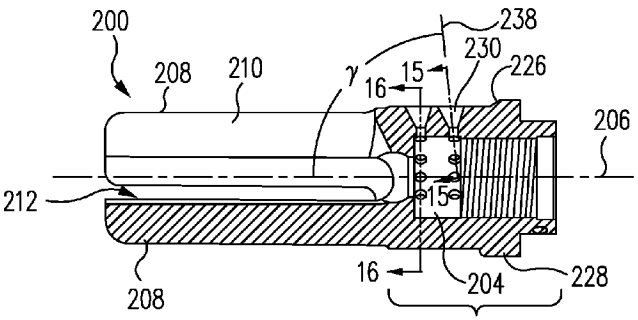
FIG. 18 is a cross-sectional view of the first example firearm attachment, as seen along the lines of the section 18-18 taken in FIG. 17 in accordance with an embodiment of the present disclosure.

As illustrated in FIGS. 3 and 4, a mechanism can be provided for removably coupling the firearm attachment 100 to the barrel 106 of the firearm 102. In the particular example embodiment of FIGS. 3 and 4, this coupling mechanism can comprise a bore 108 extending into the rear end of the attachment 100, the bore 108 having an internal thread configured to engage a complementary external thread 110 disposed on the muzzle end portion of the barrel 106 of the firearm 102. Of course, other mechanisms for coupling firearm attachments to barrels, as well as for coupling firearm accessories, such as sound suppressors, to the firearm attachments, are also available, as described in, e.g., U.S. Pat. No. 8,209,895 issued Jul. 3, 2012, U.S. Pat. No. 7,946,069 issued May 24, 2011, U.S. Pat. No. 7,676,976 issued Mar. 16, 2010, and U.S. Pat. No. 6,948,415 issued Sep. 27, 2005, the entire disclosure of each of which is incorporated herein by reference.

In the particular example embodiment illustrated in FIGS. 1-4, the rifle comprises an M4 carbine, i.e., a variant of the standard M16A2 military assault rifle. However, as will be understood by those of some skill in this art, the firearm attachment 100 can also be used with firearms of different calibers, makes and types, such as semiautomatic or fully automatic pistols, machine pistols or rifles. The example sound suppressor 104 illustrated in the figures can comprise, for example, any of the suppressors described in detail in the above-mentioned U.S. patents, U.S. Pat. No. 8,459,406 issued Jun. 11, 2013, and/or U.S. Pat. No. 8,505,680 issued Aug. 13, 2013, the entire disclosure of each of which is incorporated herein by reference.

In various embodiments, the circumferential surface of the firearm attachment 100 can be adapted to be inserted into a complementary socket disposed in the suppressor 104, as illustrated in FIG. 4. In various embodiments, firearm attachments are provided that can operate as both a flash hider and a muzzle brake.

Two example embodiments of such firearm attachments 200 and 300 are illustrated in FIGS. 5-18 and 19-32, respectively, and comprise novel firearm flash hiders and muzzle brakes that are also adapted to reliably attach a suppressor 104 to and in substantially precise alignment with the barrel 106 of a firearm 102.

As may be seen from a comparison of the two sets of figures, the two attachments 200 and 300, which are respectively configured to mount to firearms of two different calibers, are similar in configuration, and differ mainly in the dimensions and arrangements of their respective features. In particular, the example attachment 200 is calibrated to mount to a rifle 102 firing a 5.56×45 mm NATO cartridge, whereas, the attachment 300 is adapted to a rifle 102 firing a cartridge corresponding to the larger 7.62×51 mm cartridge previously used by NATO forces. However, as discussed above, it should be understood that the attachments 200 and 300 can also be calibrated and configured to operate with a wide variety of other firearm types and calibers. Accordingly, although the following description is presented in the context of the example attachment 200, the description is, except where specific differences are noted, likewise applicable to the example attachment 300.

The example firearm attachments 200/300 can be seen to include a base 202/302 adapted to be coupled to a muzzle end of the barrel of a firearm, a bore 204/304 that is concentric with a central axis 206/306 of the attachment 200/300, and three substantially longitudinal tines 208/308 extending forwardly from the base 202/302 and arranged circumferentially around the central axis 206/306. The tines 208/308 have generally planar sidewalls 210/310 and the opposing sidewalls 210/310 of adjacent ones of the tines 208/308 define three longitudinal slots 212/312 that extend rearwardly from the front of the attachment 200/300 to the base 202/302, and which are adapted to exhaust combustion gases from the bore 204/304 when a firearm to which the attachment 200/300 is mounted is discharged (e.g., cycled).

The tines 208/308 and at least a front portion of the base 202/302 can be adapted to be inserted into a complementary socket of a firearm sound suppressor 104, and a rear portion of the base 202/302 can comprise, for example, a frustoconical external surface that defines a plug 226/326 configured to be received in a slide-in engagement with a complementary socket in the suppressor 104. The plug 226/326 can include a tab 228/328 extending therefrom, the tab 228/328 being adapted to be received by a corresponding slot disposed in the interior surface of the socket of the suppressor so as to rotationally align the sound suppressor relative to the firearm. The tab 228/328 can extend longitudinally along the base 202/302 and can be chamfered for a slide-in engagement within a complementary inclined recess disposed in the socket of the suppressor.

While the attachment features described thus far enable the attachments 200 and 300 to operate effectively as both flash hiders and as mechanisms for coupling a sound suppressor to a firearm, it can be desirable in a number of applications for the attachment to operate as a muzzle brake or a recoil compensator. In particular, it is desirable, for reasons of weapon accuracy, to provide firearm attachments with features that enable them to effectively suppress or eliminate muzzle climb or muzzle rise after firing or cycling of the weapon, particularly during rapid or automatic firing of the weapon.

The two example firearm attachments 200 and 300 described herein address the muzzle climb problem in the context of two possible firing scenarios. The first of these relates to a situation in which the shooter is firing a weapon "freestyle," i.e., without any support of the weapon other than, e.g., a sling. The second relates to a situation in which the shooter is firing a weapon that is supported by, e.g., a so-called "bipod," i.e., a collapsible support stand forming a V, the apex of which is typically coupled to the forward end portion of the weapon's barrel, and two legs, each having a lower end disposed in contact with a fixed surface, for example, the ground.

In the first scenario, the muzzle of the weapon has a tendency, after firing, to rotate upwards relative to the horizontal, and either to the right or to the left relative to the shooter, depending on whether the shooter is right-handed or left-handed, respectively. In the second scenario, the muzzle tends only to rise vertically, since contact of the legs of the bipod support with the ground effectively prevent the muzzle from pulling right or left, and accordingly, the chirality of the shooter becomes relatively unimportant. The first example firearm attachment 200 of FIGS. 5-18 includes features that effectively address the issue of muzzle climb and pull in the first scenario, and the second example firearm attachment 300 of FIGS. 19-32 includes features that effectively address the issue of muzzle climb in the second scenario More particularly, the base 202 of the first example attachment 200 includes a plurality of first apertures 230 that are disposed rearward of the longitudinal tines 208 and slots 212, and that extend into the bore 204 from an upper surface of the outer circumfery of the attachment 200, as well as a plurality of second apertures 232 that are disposed rearward of the longitudinal tines 208 and slots 212, and that extend into the bore 204 from a right or a left side surface of the outer circumfery of the attachment 200.

Figure 15:
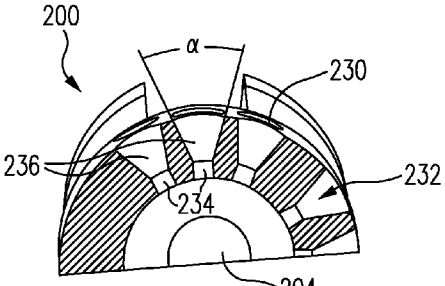
FIG. 15 is an enlarged, partial cross-sectional view of the first example firearm attachment, as seen along the lines of the section 15-15 taken in FIG. 18 in accordance with an embodiment of the present disclosure.
Figure 20:
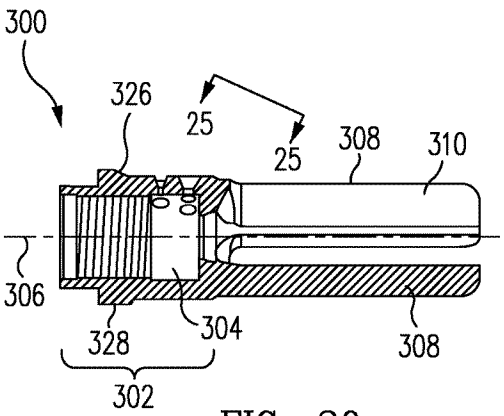
FIG. 20 is a cross-sectional view of the second example firearm attachment, as seen along the lines of the section 20-20 taken in FIG. 19 in accordance with an embodiment of the present disclosure.
Figure 19:
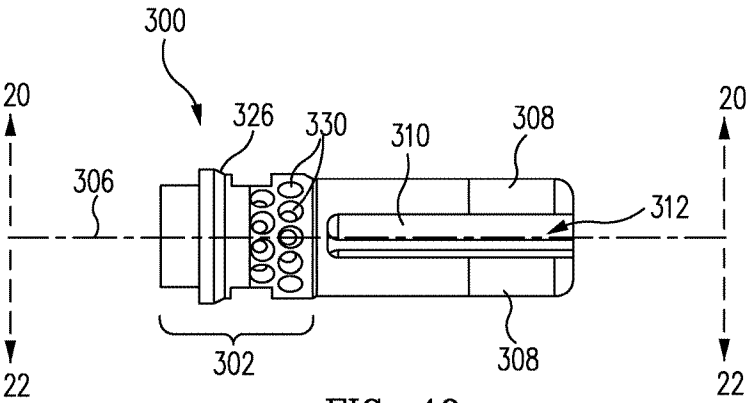
FIG. 19 is a top plan view of a second example embodiment of a firearm attachment in accordance with an embodiment of the present disclosure.
Figure 22:
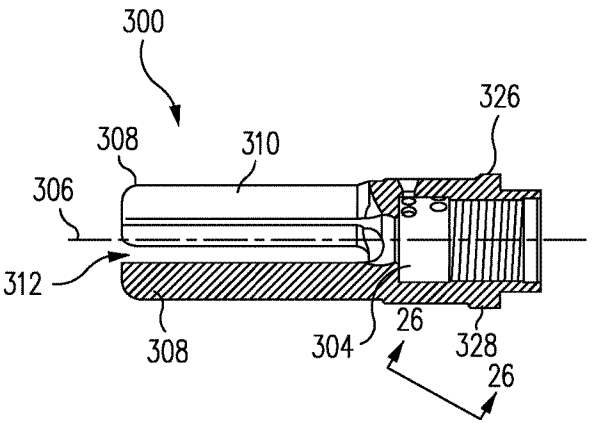
FIG. 22 is a cross-sectional view of the second example firearm attachment, as seen along the lines of the section 22-22 taken in FIG. 19 in accordance with an embodiment of the present disclosure.
Figure 21:
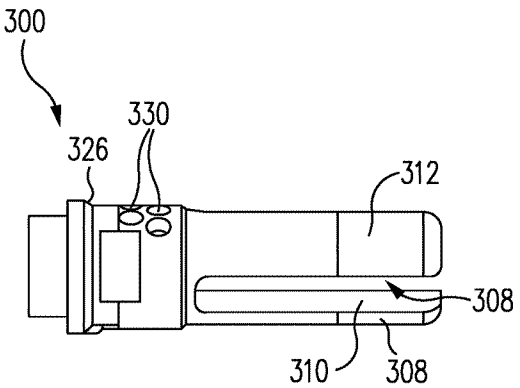
FIG. 21 is a right side elevation view of the second example firearm attachment in accordance with an embodiment of the present disclosure.
Figure 24:
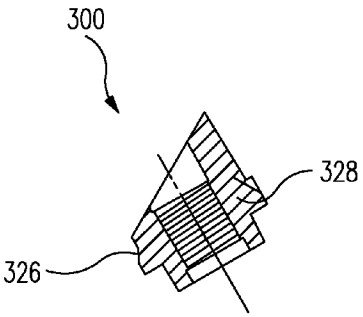
FIG. 24 is a partial cross-sectional view of the second example firearm attachment, as seen along the lines of the section 30-30 taken in FIG. 32 in accordance with an embodiment of the present disclosure.
Figure 26:
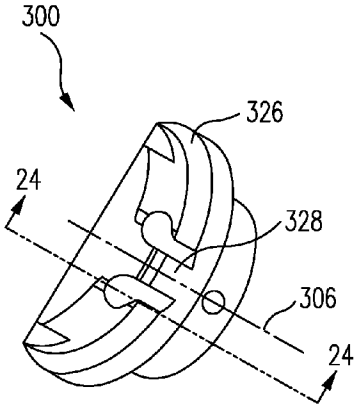
FIG. 26 is an enlarged partial detail view of the second example firearm attachment, as seen along the lines of the view 26-26 taken in FIG. 22 in accordance with an embodiment of the present disclosure.
Figure 23:
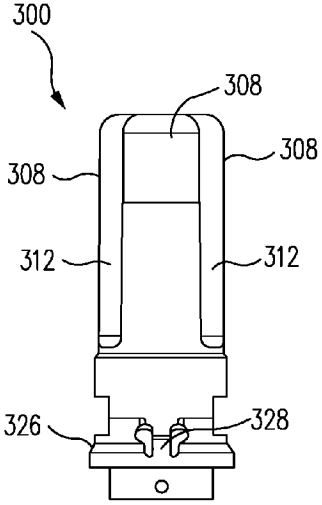
FIG. 23 is a bottom plan view of the second example firearm attachment in accordance with an embodiment of the present disclosure.
Figure 25:
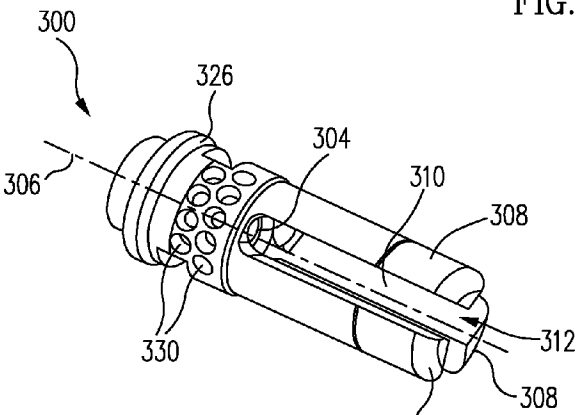
FIG. 25 is an upper, front end perspective view of the second example firearm attachment, as seen along the lines of the view 25-25 taken in FIG. 20 in accordance with an embodiment of the present disclosure.
Figure 31:
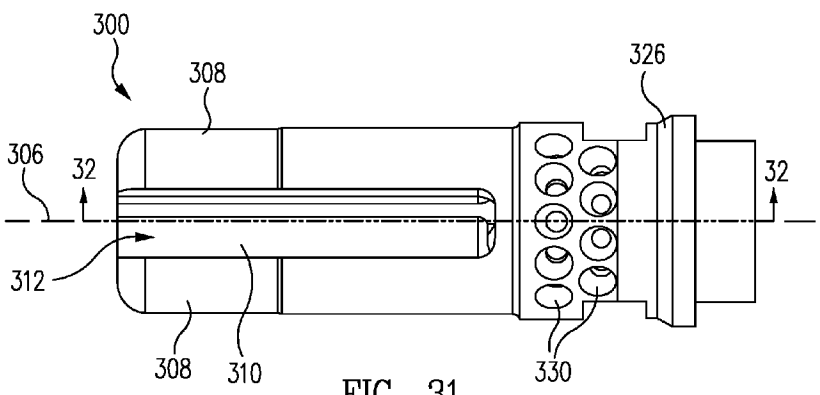
FIG. 31 is another, enlarged top plan view of the second example firearm attachment in accordance with an embodiment of the present disclosure.

As illustrated in, e.g., the enlarged partial cross-sectional view of FIG. 15, in the first example attachment 200, each of the first and second apertures 230 and 232 comprises a generally radially extending circular aperture that includes a cylindrical inner section 234 having an inner end that intersects the bore 204, and a frusto-conical outer section 236 having an inner end conterminous with an outer end of the cylindrical section 234, and an outer end that intersects the outer circumfery of the attachment 200. As illustrated in FIG. 15, the outer end of the frusto-conical section 234 has a diameter that is larger than the diameter of its inner end, i.e., the frusto-conical section flares out towards the circumfery of the base 202, and hence, the ambient air surrounding it.

As those of some skill will recognize, the configuration of the top and side surface apertures 230 and 232 providing a nozzle substantially similar to that of a rocket nozzle, in which the bore 204 of the attachment 200 corresponds to a "combustion chamber" of the nozzle, the cylindrical section 234 to a "throat" of the nozzle, and the frusto-conical section 236 to a "bell" or expansion section of the nozzle. Thus, in operation, the high-temperature, high-pressure gases generated by a burning propellant during the firing of an associated firearm enter the bore 204, accelerate to sonic velocities as they pass through the constriction of the throat, or cylindrical section 234 of the nozzle, then expand rapidly through the bell, or frusto-conical section 236 of the nozzle, causing the gases to accelerate to supersonic velocities and to cool, or drop substantially in temperature.

The acceleration of the combustion gases through the apertures 230 and 232 results in a thrust being imparted to the attachment 200, and hence, to the muzzle end of the barrel of the firearm to which it is attached, that is in a direction opposite to that of the flow of the gases through the apertures. Accordingly, the first apertures 230 disposed on the upper surface of the attachment 200 serve to compensate for (e.g., offset or eliminate) the tendency of the muzzle to climb or rise after firing, whereas, the second apertures 232 disposed on either the right or left side surface of the attachment 200 serve to offset or eliminate the tendency of the muzzle to pull to the right or to the left, respectively, after firing. Thus, as above, if the shooter is right-handed, then the second apertures 232 should be disposed on the right side of the attachment 200 to compensate for a right-hand pull, and if the shooter is left-handed, should be disposed on the left side of the attachment 200, to compensate for a left-hand pull. The particular example attachment 200 of FIGS. 5-18 is configured for a right-handed shooter.

In addition to the foregoing, the rapid expansion and accompanying cooling of the gasses in the apertures 230 and 232 results in a substantial reduction in any further combustion of the gases, and hence, muzzle flash exhibited at the outlets of the first and second apertures 230 and 232. Thus, experiments have shown that in embodiments incorporating the "muzzle braking" apertures 230/330 and/or 232, the addition of the apertures to the attachments 200 or 300 result in virtually no increase in the amount of visible muzzle flash during the firing of weapons to which the attachments 200 or 300 are coupled.

In the particular first example attachment 200 illustrated, the cylindrical sections 234 of the first and second apertures 230 and 232 have a diameter of about 0.062 inches, and their frusto-conical sections 236 subtend (e.g., taper) an angle $\alpha$ of about 40 degrees (see FIG. 15). However, these dimensions can vary as appropriate for different applications.

The upper or first apertures 230 of the attachment 200 are distributed in an arc about the outer circumfery of the attachment 200. For example, apertures 230 are disposed symmetrically with respect to a sagittal plane of the attachment 200, i.e., to a vertical plane passing through the central axis 206 of the attachment 200. Further, the first apertures 230 are disposed in two circumferential rows of three evenly distributed apertures 230 each, e.g., are also disposed symmetrically with respect to a transverse plane passing perpendicularly through the attachment 200 and the central axis 206 thereof.

In the particular example attachment 200 illustrated, the side, or second apertures 232 are also distributed in an arc about the outer circumfery of the attachment 200. For example, apertures 232 are disposed symmetrically with respect to a coronal plane of the attachment, i.e., a horizontal plane passing through the central axis 206 of the attachment 200, and like the first apertures 230, can also be disposed in two rows of three evenly distributed apertures 232 each, e.g., such that they are likewise disposed symmetrical to a transverse plane passing perpendicularly through the central axis 206 of the attachment 200. However, as above, the number and arrangement of the first and/or the second apertures 230 and/or 232 can vary as appropriate for different applications.

In various embodiments, any of apertures 230/232 may be distributed (e.g., positioned) in an arc that comprises only a portion of the outer circumfery of the attachment 200 (e.g., less than one half of the outer circumfery) to impart thrust to attachment 200 in one or more desired directions. For example, by orienting attachment 200 in a manner such that apertures 230/232 are pointing upward and to the right (e.g., see FIGS. 15 and 16), combustion gases passing from the bore 204 to apertures 230/232 will impart thrust to attachment 200 in downward and leftward directions to compensate for muzzle rise (e.g., muzzle climb) and rightward muzzle pull (e.g., in the case of a right-handed shooter).

Figure 16:
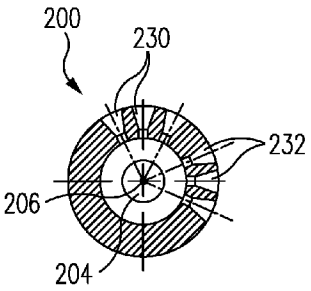
FIG. 16 is a cross-sectional view of the first example firearm attachment, as seen along the lines of the section 16-16 taken in FIG. 18 in accordance with an embodiment of the present disclosure.
Figure 13:
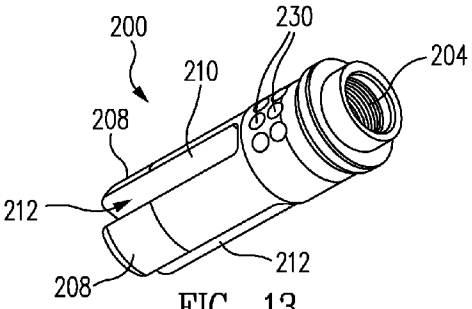
FIG. 13 is an upper, rear end, left side perspective view of the first example firearm attachment in accordance with an embodiment of the present disclosure.
Figure 14:
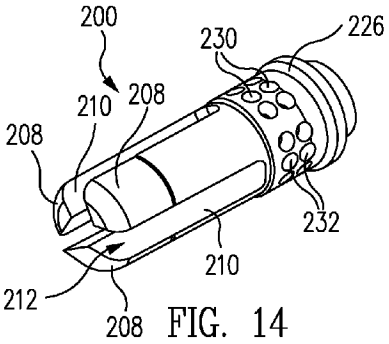
FIG. 14 is an upper, front end, right side perspective view of the first firearm attachment in accordance with an embodiment of the present disclosure.

Similarly, by orienting attachment 200 in a manner such that apertures 230/232 are pointing upward and to the left (e.g., an approximately 90 degree counterclockwise rotation in relation to FIGS. 15 and 16), combustion gases passing from the bore 204 to apertures 230/232 will impart thrust to attachment 200 in downward and rightward directions to compensate for muzzle rise and leftward muzzle pull (e.g., in the case of a left-handed shooter).

In some embodiments, smaller arc distributions may be used (e.g., less than one third, less than one quarter, or other portions of the outer circumfery) to impart thrust in fewer and/or more specific directions (e.g., to selectively compensate for muzzle rise or muzzle pull).

In various embodiments, any of the arc distributions discussed in relation to apertures 230/232 may be used with any of the various apertures (e.g., apertures 230, 232, 330, 410, 425, 430, 450, 470) and/or attachments (e.g., attachments 100, 200, 300, 400, 420, 440, 460) of the present disclosure as desired to impart thrust to compensate for muzzle rise and/or muzzle pull.

In some embodiments, one or more of the first and/or the second apertures 230 and/or 232 can be disposed concentrically with respect to an axis 238 that is tilted forwardly at an acute angle $\gamma$ relative to the central axis 206 of the attachment 200. As those of some skill will understand, this slight forward-tilt arrangement of the apertures 230 and/or 232 will result in a relatively small reduction of the forces available to react muzzle climb or right/left pull, but will also result in an advantageous and significant reduction in the amount of muzzle blast, debris, and particulate reaching the ears and faces of the shooter and persons disposed on either side of the shooter during weapon firing, as compared to embodiments in which the apertures 230 and/or 232 extend strictly in a radial direction. In the particular example attachment 200 illustrated, the acute angle γ is about 85 degrees, but as above, can vary.

The features of the second example firearm attachment 300 are similar to those of the first example attachment 200 above, except that, as discussed above, the second attachment 300 is directed to embodiments in which the weapons to which they are attached are equipped with bipods, which have the effect of substantially eliminating right/left movement of the weapons' muzzles during firing. Accordingly, in the second example embodiment 300, side or second apertures are omitted, and the muzzle brake apertures 330 are confined to a plurality of upper apertures 330 that are disposed rearward of the longitudinal tines 308 and slots 312, and that extend into the bore 304 from an upper surface of the outer circumfery of the attachment 300.

Figure 28:
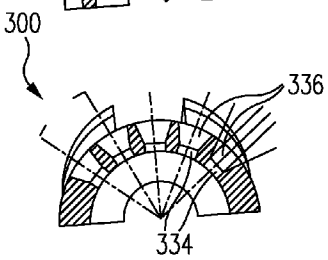
FIG. 28 is an enlarged partial cross-sectional view of the second example firearm attachment, as seen along the lines of the section 28-28 taken in FIG. 32 in accordance with an embodiment of the present disclosure.
Figure 29:
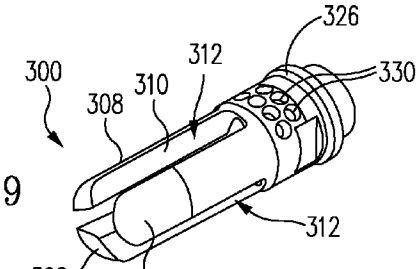
FIG. 29 is an upper, front end, left side perspective view of the second example firearm attachment in accordance with an embodiment of the present disclosure.
Figure 30:
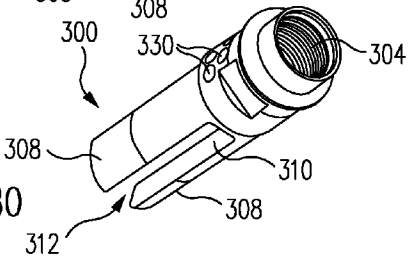
FIG. 30 is a lower, rear end, left side perspective view of the second example firearm attachment in accordance with an embodiment of the present disclosure.

The configuration of the apertures 330 can be substantially similar to those of the first embodiment, except that in the second embodiment, which as above, can be directed to a larger caliber weapon, the diameter of the cylindrical sections 334 can be larger, e.g., 0.093 inches, to accommodate this difference, and this would result in the apertures 330 having correspondingly larger frusto-conical segments 336 (see FIG. 28).

The apertures 330 of the second example attachment 300, like the first apertures 230 of the first example attachment 200 above, are distributed in an arc about the outer circumfery of the attachment 300. For example, apertures 330 are disposed symmetrically with respect to a sagittal plane of the attachment 300, and can comprise two circumferential rows of the apertures 330. However, in the particular example attachment illustrated in FIGS. 19-32, a first one of the circumferential rows can comprise, e.g., five evenly distributed apertures 330, and a second one of the rows can comprise, e.g., four evenly distributed apertures 330, the result of which is that the apertures 330 will be disposed asymmetrically with respect to a transverse plane of the attachment.

Figure 32:
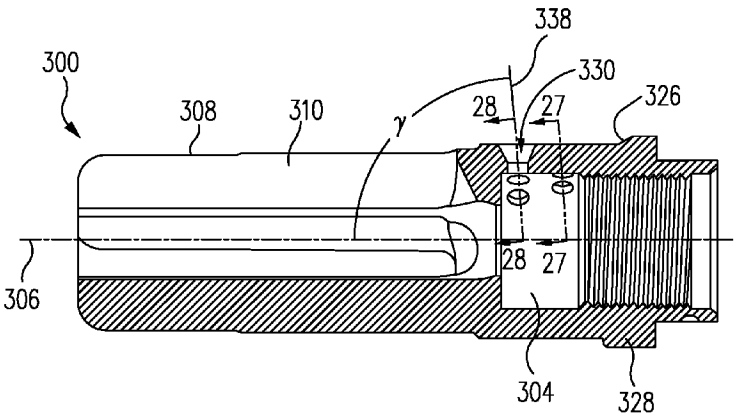
FIG. 32 is a cross-sectional view of the second example firearm attachment, as seen along the lines of the section 32-32 taken in FIG. 31 in accordance with an embodiment of the present disclosure.
Figure 27:
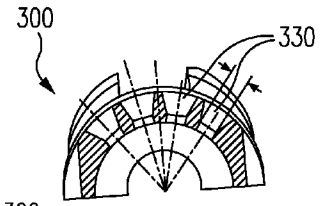
FIG. 27 is an enlarged partial cross-sectional view of the second example firearm attachment, as seen along the lines of the section 27-27 taken in FIG. 32 in accordance with an embodiment of the present disclosure.

A final difference between the first example firearm attachment 200 and the second example attachment 300 can relate to the optional forward tilt of one or more of the apertures 330. Thus, as illustrated in FIG. 32, in the second attachment 300, one or more of the apertures 330 can be disposed concentrically with an axis 338 that is tilted forwardly at an acute angle γ of about 65 degrees relative to the central axis 306 of the attachment 300. However, as discussed above, the number, arrangement, size and amount of forward tilt, if any, of the apertures 330 can be varied widely, depending on the particular application at hand.

Figure 33A:
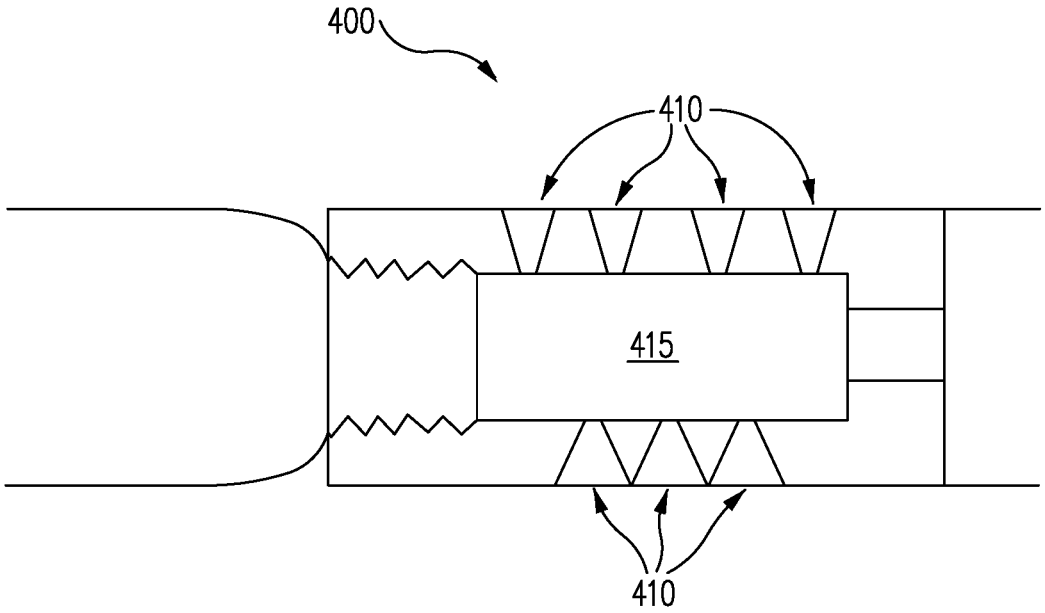
FIGS. 33A-D illustrate additional example embodiments of firearm attachments in accordance with the present disclosure.

Although particular aperture shapes and distributions have been discussed, others may be used. For example, FIG. 33A illustrates a cross-sectional view of an example firearm attachment 400 with different numbers of apertures 410 positioned on substantially opposite sides of the attachment 400. In the illustrated embodiment, apertures 410 subtend (e.g., taper) substantially about their entire depth from an internal bore 415 to an outer circumfery of the attachment 400, however, a substantially untapered portion may be provided (e.g., proximate bore 415 or otherwise) as part of apertures 410 in various embodiments.

Figure 33B:
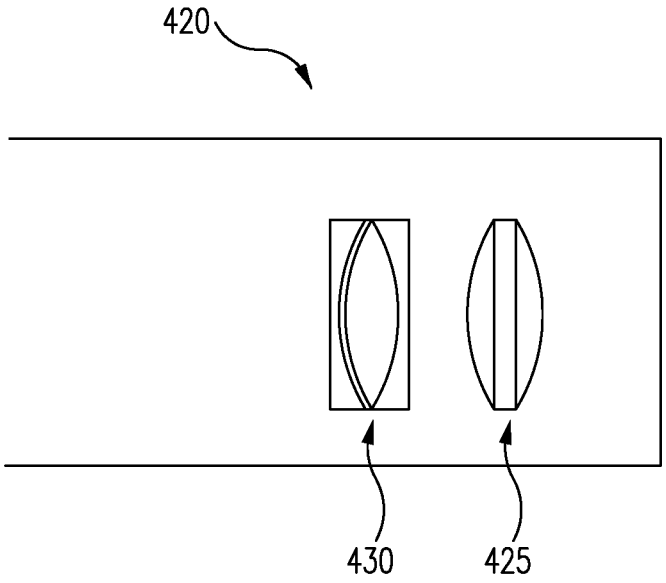

FIG. 33B illustrates an external surface of an example firearm attachment 420 with apertures 425 and 430 implemented as slots. In this regard, aperture 425 exhibits a substantially rectangular perimeter within the attachment 420, and tapers to a substantially curved perimeter (e.g., oval) at the outer circumfery of the attachment 420. In contrast, aperture 430 exhibits a substantially curved perimeter within the attachment 420, and tapers to a substantially rectangular perimeter at the outer circumfery of the attachment 420.

Figure 33C:
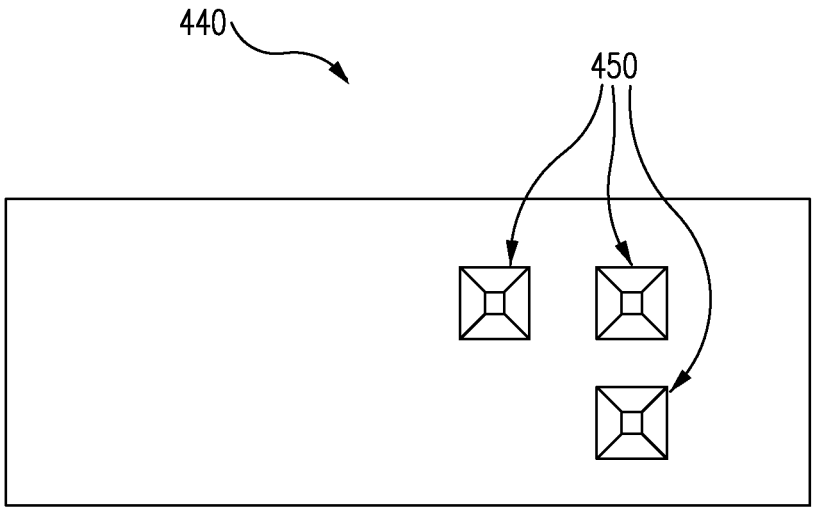

FIG. 33C illustrates an external surface of an example firearm attachment 440 with apertures 450 implemented as substantially square tapered apertures. In this regard, apertures 450 exhibit a substantially square perimeter within the attachment 440, and taper to a larger substantially square perimeter at the outer circumfery of the attachment 440. As also shown in FIG. 33C, different numbers of apertures 450 are provided in two rows along the outer circumfery of the attachment 440.

Figure 33D:
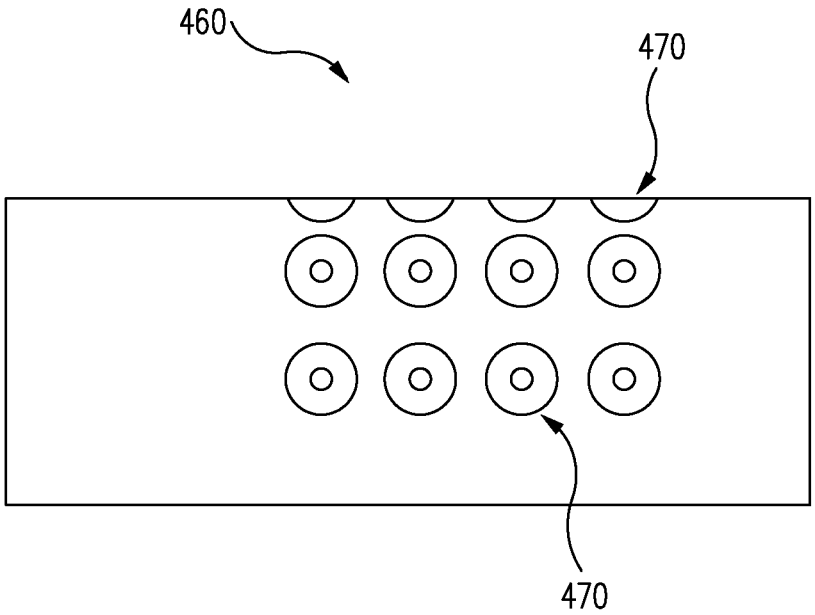

FIG. 33D illustrates an external surface of an example firearm attachment 460 with apertures 470 implemented as substantially circular tapered apertures. In this regard, apertures 470 exhibit a substantially circular perimeter within the attachment 460, and taper to a larger substantially circular perimeter at the outer circumfery of the attachment 460. As also shown in FIG. 33D, apertures 470 are distributed in several rows along the outer circumfery of the attachment 460.

Accordingly, it will be understood that a wide variety of different shapes, distributions, and types of apertures are contemplated, any portions of which may be used in combination as desired for particular implementations.

Indeed, as those of some skill in this art will appreciate, and depending on the particular application at hand, many modifications, substitutions and variations can be made in and to the materials, apparatus, configurations and methods of use and production of the firearm attachments of the present disclosure without departing from the spirit and scope of the invention. In light of this, the scope of the present invention should not be limited to those of the particular embodiments illustrated and described herein, as they are merely by way of some examples thereof, but rather, should be fully commensurate with that of the claims appended hereafter and their functional equivalents.

What is claimed is:

1. A firearm attachment, comprising:

a base adapted to couple to a muzzle end of a barrel of a firearm;

a flash hider that extends forward from the base;

wherein the base comprises less than half of a length of the firearm attachment and includes a plurality of apertures disposed rearward of the flash hider that extend from a bore within the base through an outer circumfery of the firearm attachment;

wherein the apertures comprise a constriction portion having a first depth and exhibiting a first fixed diameter extending to the bore, and an expansion portion having a second depth greater than the first depth and exhibiting a second larger increasing diameter extending to the outer circumfery, wherein the expansion portion subtends at an angle of 40 degrees; and wherein the apertures are distributed in an arc that is less than half of the outer circumfery and are adapted to impart thrust to the firearm attachment in response to combustion gases passed from the bore through the apertures to compensate for an undesired muzzle movement associated with the firearm.

2. The firearm attachment of claim 1, wherein the constriction portion exhibits a substantially cylindrical cross-section and the expansion portion exhibits a substantially frusto-conical cross-section.

3. The firearm attachment of claim 1, wherein the constriction and expansion portions form a nozzle.

4. The firearm attachment of claim 1, wherein the first diameter is in a range of 0.062 inches to 0.093 inches.

5. The firearm attachment of claim 1, wherein at least one of the apertures is concentric with an axis that is tilted forwardly at an acute angle relative to a central axis of the firearm attachment.

6. The firearm attachment of claim 5, wherein the acute angle is in a range of 65 degrees to 85 degrees.

7. The firearm attachment of claim 1, wherein the flash hider comprises a plurality of longitudinal tines adapted to substantially hide at least a portion of a muzzle flash associated with the firearm, wherein the apertures are distributed in a first aperture cluster comprising a first plurality of the apertures and a second aperture cluster distinct from the first aperture cluster and comprising a second plurality of the apertures, wherein both the first aperture cluster and the second aperture cluster are disposed in the arc, wherein the arc is between 100 to 150 degrees of the outer circumfery.

8. The firearm attachment of claim 1, wherein:

the apertures are a first plurality of apertures;

the arc is a first arc;

the muzzle movement is a first muzzle movement;

the base includes a second plurality of apertures disposed rearward of the flash hider and that extend from the bore through the outer circumfery of the firearm attachment;

the second apertures exhibit the first diameter at the bore and the second larger diameter at the outer circumfery;

the second apertures are adapted to impart thrust to the firearm attachment in response to combustion gases passed from the bore through the second apertures to compensate for a second undesired muzzle movement associated with the firearm; and the first and second apertures are collectively distributed in a second arc less than half of the outer circumfery of the firearm attachment.

9. A method comprising:

providing a firearm attachment comprising:

a base coupled to a muzzle end of a barrel of a firearm, a flash hider that extends forward from the base, wherein the base comprises less than half of a length of the firearm attachment and includes a plurality of apertures disposed rearward of the flash hider that extend from a bore within the base through an outer circumfery of the firearm attachment, wherein the apertures comprise a constriction portion having a first depth and exhibiting a first fixed diameter extending to the bore, and an expansion portion having a second depth greater than the first depth and exhibiting a second larger increasing diameter extending to the outer circumfery, wherein the expansion portion subtends at an angle of 40 degrees; and wherein the apertures are distributed in an arc that is less than half of the outer circumfery; and passing combustion gases of the firearm from the bore through the apertures to impart thrust to the attachment to compensate for an undesired muzzle movement associated with the firearm.

10. The method of claim 9, wherein the constriction portion exhibits a substantially cylindrical cross-section and the expansion portion exhibits a substantially frusto-conical cross-section.

11. The method of claim 9, wherein the constriction and expansion portions form a nozzle.

12. The method of claim 9, wherein at least one of the apertures is concentric with an axis that is tilted forwardly at an acute angle relative to a central axis of the attachment.

13. The method of claim 12, wherein the acute angle is in a range of 65 degrees to 85 degrees.

14. The method of claim 9, wherein the flash hider comprises a plurality of longitudinal tines adapted to substantially hide at least a portion of a muzzle flash associated with the firearm, wherein the apertures are distributed in a first aperture cluster comprising a first plurality of the apertures and a second aperture cluster distinct from the first aperture cluster and comprising a second plurality of the apertures, wherein both the first aperture cluster and the second aperture cluster are disposed in the arc, wherein the arc is between 100 to 150 degrees of the outer circumfery.

15. The method of claim 9, wherein:

the apertures are a first plurality of apertures;

the arc is a first arc;

the muzzle movement is a first muzzle movement;

the base includes a second plurality of apertures disposed rearward of the flash hider and that extend from the bore through the outer circumfery of the attachment;

the second apertures exhibit the first diameter at the bore and the second larger diameter at the outer circumfery;

the first and second apertures are collectively distributed in a second arc less than half of the outer circumfery of the firearm attachment; and the method further comprises passing combustion gases of the firearm from the bore through the second apertures to impart thrust to the attachment to compensate for a second undesired muzzle movement associated with the firearm.

16. The firearm attachment of claim 1, wherein:

the constriction portion exhibits a substantially cylindrical cross-section and the expansion portion exhibits a substantially frusto-conical cross-section forming a nozzle; and the expansion portion comprises more than half of the nozzle.

17. The method of claim 9, wherein:

the constriction portion exhibits a substantially cylindrical cross-section and the expansion portion exhibits a substantially frusto-conical cross-section forming a nozzle; and the expansion portion comprises more than half of the nozzle.

18. The method of claim 9, wherein the first diameter is in a range of 0.062 inches to 0.093 inches.

19. The firearm attachment of claim 1, wherein the base comprises first and second complementary external surfaces collectively providing an outer circumfery of the firearm attachment, wherein the apertures are distributed in an arc along the first external surface, and wherein the second external surface is a non-perforated continuous surface that is more than half of the outer circumfery.

20. The method of claim 9, wherein the base comprises first and second complementary external surfaces collectively providing an outer circumfery of the firearm attachment, wherein the apertures are distributed in an arc along the first external surface, and wherein the second external surface is a non-perforated continuous surface that is more than half of the outer circumfery.

* * * * *